US009452603B1

(12) United States Patent
Morizono et al.

(10) Patent No.: US 9,452,603 B1
(45) Date of Patent: Sep. 27, 2016

(54) PRINTING APPARATUS

(71) Applicant: SCREEN HOLDINGS CO., LTD., Kyoto (JP)

(72) Inventors: Osamu Morizono, Kyoto (JP); Kazuki Fukui, Kyoto (JP); Tomotaka Kato, Kyoto (JP); Kunio Muraji, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/076,417

(22) Filed: Mar. 21, 2016

(30) Foreign Application Priority Data

Mar. 27, 2015 (JP) ..... 2015-066616

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/01; B41J 29/38; B41J 2/04505; B41J 2/04586; B41J 2/045; B41M 7/0009
See application file for complete search history.

(56) References Cited

U.S. PATENT DOCUMENTS 7,384,128 B2 * 6/2008 Sheahan ..... B41J 2/0451 347/40

FOREIGN PATENT DOCUMENTS

JP 2010-158814 A 7/2010

* cited by examiner

*Primary Examiner* — Thinh Nguyen
(74) *Attorney, Agent, or Firm* — McDermott Will & Emery LLP

(57) ABSTRACT

Disclosed is a printing apparatus that performs printing onto a print medium including a transporting device that transports a print medium, a plurality of printing heads, a photographing unit that photographs the print medium, a shift detecting chart forming device, and a correcting device. The shift detecting chart forming device forms a shift detecting chart having a first line segment group consisting of first line segments that are printed onto the print medium at given intervals in an orthogonal direction with respect to the transportation direction with a reference printing head, and a second line segment group formed along the first line segment group, and consisting of second line segments that are printed with a subsequent printing head. The correcting device corrects a printing timing with the subsequent printing head relative to the reference printing head in accordance with a density variation of the photographed shift detecting chart.

20 Claims, 6 Drawing Sheets

PRINTING APPARATUS

TECHNICAL FIELD

The present invention relates to a printing apparatus that performs printing with a plurality of printing heads spaced away in a transportation direction of a print medium.

BACKGROUND ART

Examples of the currently-used printing apparatus of this type include a printer provided with printing heads, first and second guide rollers, a rotary encoder, and a drive roller (see, for example, Japanese Unexamined Patent Publication 2010-158814).

In the printer, the first guide roller, the second guide roller, and the drive roller are disposed in this order from upstream on a transportation path for web paper, and the printing heads are disposed between the first and second guide rollers. Here, printing is performed while discharge timings of ink droplets from the printing heads are controlled in accordance with a transportation speed of the web paper.

The transportation speed of the web paper and the discharge timings of the ink droplets from the inkjet heads influence printing quality. Accordingly, the transportation speed of the web paper is determined by detecting a number of rotations of the second guide roller downstream of the printing heads with a rotary encoder, and the discharge timings from the printing heads are each adjusted based on the transportation speed. This allows accurate detection of change in transportation speed adjacent to the printing heads and thus allows adjustment of the discharge timings of the ink droplets. This achieves suppression of misregister caused by the variation in transportation speed, leading to enhanced printing quality.

However, the example of the currently-used apparatus with such a construction has the following drawback.

That is, the currently-used apparatus performs printing based on indirect information from the rotary encoder although the discharge timings of the ink droplets are adjusted based on the transportation speed of the web paper. As a result, misregister caused by the change in transportation speed of the web paper may possibly remain. Especially, the printer with high resolution may possess a drawback that extremely minute residue of the misregister causes degraded printing quality.

SUMMARY OF INVENTION

The present invention has been made regarding the state of the art noted above, and its one object is to provide a printing apparatus that allows suppression of extremely minute misregister, caused by a change in transportation speed, and enhanced printing quality by directly obtaining information on the transportation speed from a print medium.

In order to accomplish the above object, the present invention adopts the following construction.

One aspect of the present invention provides a printing apparatus that performs printing onto a print medium. The printing apparatus includes a transporting device; a plurality of printing head; a photographing unit; a shift detecting chart forming device; and a correcting device. The transporting device transports a print medium. The printing heads are spaced away from one another in a transportation direction of the print medium and print an image onto the print medium. The photographing unit photographs the print medium onto which the printing is performed with the printing heads. The shift detecting chart forming device forms a shift detecting chart having a first line segment group and a second line segment group. The first line segment group consists of first line segments printed onto the print medium at given intervals in an orthogonal direction with respect to the transportation direction with a reference printing head of the printing heads for a reference printing position in the transportation direction. The second line segment group is formed along the first line segment group, and consists of second line segments printed with a subsequent printing head of the printing heads spaced away from the reference printing head in the transportation direction in such a way that distances to the first line segments become small sequentially and then distances becomes large sequentially in a direction from one of the first line segments to another one of the first line segments, or in such a way that distances to the first line segments become large sequentially and then distances becomes small sequentially in a direction from one of the first line segments to another one of the first line segments. The correcting device corrects a printing timing with the subsequent printing head relative to the reference printing head in accordance with a density variation of the shift detecting chart photographed with the photographing unit.

With the above aspect of the present invention, in the shift detecting chart formed by the shift detecting chart forming device, an overlap between the first line segment group and the second line segment group is variable as a transportation speed of the print medium by the transporting device changes. Accordingly, a portion with high density or a portion with low density is shifted toward one side of the shift detecting chart. The correcting device corrects the printing timing with the subsequent printing head relative to the reference printing head in accordance with the density variation of the shift detecting chart photographed with the photographing unit. Consequently, information on the transportation speed of the print medium is directly obtainable from the shift detecting chart. This allows enhanced printing quality along with suppression in extremely minute misregister caused by the change in transportation speed.

Moreover, it is preferred in the aspect of the present invention that the shift detecting chart forming device forms the shift detecting chart following a printing start mark printed beyond a printing area of the print medium.

The shift detecting chart is formed beyond the printing area. This eliminates an influence on the image within the printing area. In addition, an image and the like formed on an opposite surface of the print medium may cause no problem upon reading the density. Consequently, accurate correction is performable based on a density variation.

Moreover, it is preferred in the aspect of the present invention that the correcting device corrects the printing timing in accordance with one of color components into which the shift detecting chart photographed with the photographing unit is decomposed.

Decomposing the color-photographed shift detecting chart into the color components allows clear density distinguishment in one of the components. Consequently, the density variation is easily visible and thus accurate correction is performable.

Moreover, it is preferred in the aspect of the present invention that the correcting device corrects the printing timing in accordance with an average value of shade levels of the line segments in one of the color components in a length direction.

The average value of the shade levels of the line segments in the length direction is calculated, and the printing timing is corrected in accordance with the average value. This allows accurate correction of the printing timing even when the components have different densities.

Moreover, it is preferred in the aspect of the present invention that the correcting device corrects the printing timing in accordance with a blue component of the color components in the shift detecting chart photographed with the photographing unit.

It is assumed that the shift detecting chart is formed in black and yellow. Under such assumption, when the color-photographed shift detecting chart is decomposed into components of R (red), G (green), and B (blue), density is clearly distinguished in the blue component. Consequently, the density variation is easily visible and thus accurate correction is performable.

Moreover, it is preferred in the present invention that the correcting device corrects the printing timing in accordance with an average value of shade levels in the blue component in the shift detecting chart in the length direction.

The average value of the shade levels of the line segments in the length direction is calculated, and the printing timing is corrected in accordance with the average value. This allows accurate correction of the printing timing even when the component has different densities.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

The following describes one embodiment of the present invention with reference to drawings.

Figure 1:
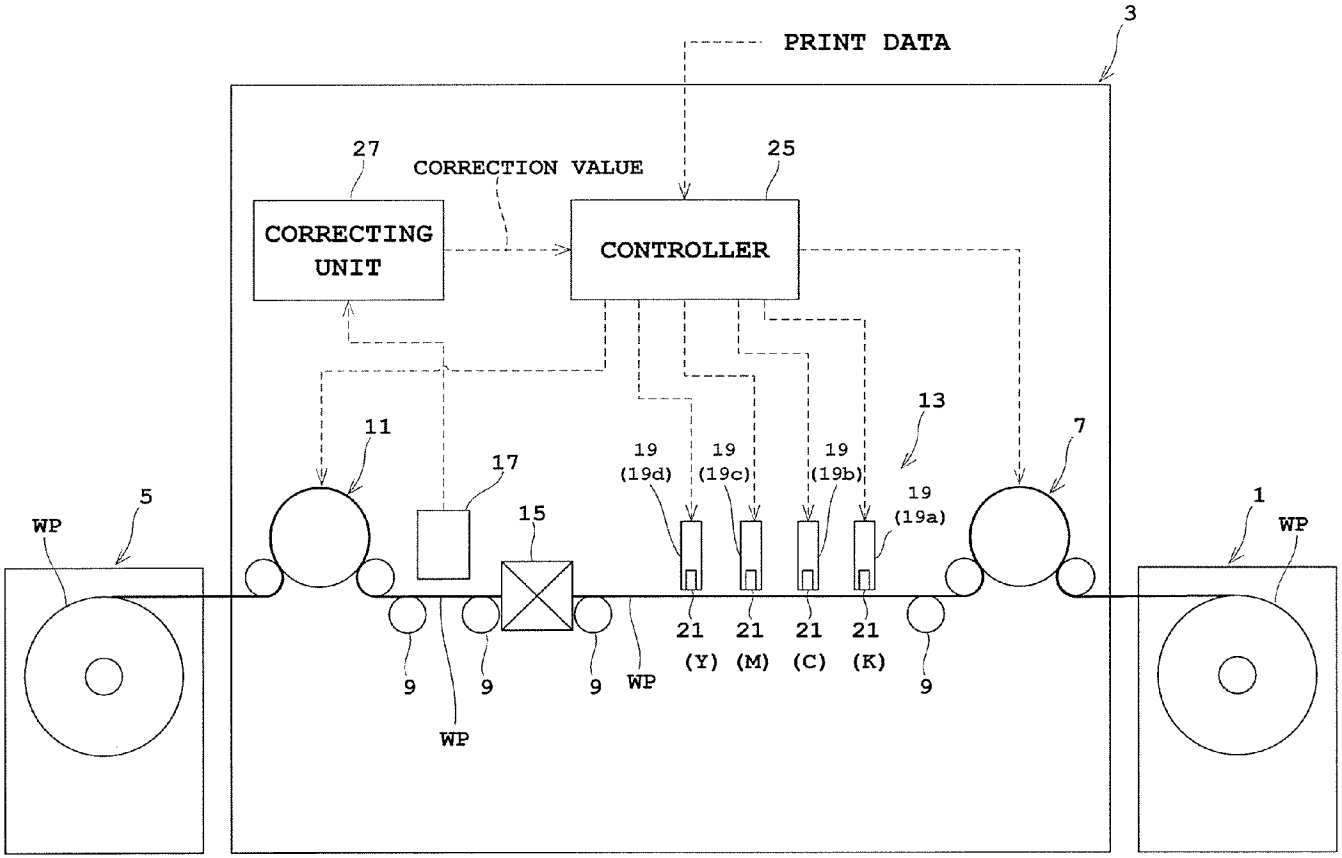
FIG. 1 is a schematic view illustrating an entire inkjet printing system according to one embodiment of the present invention.
Figure 2:
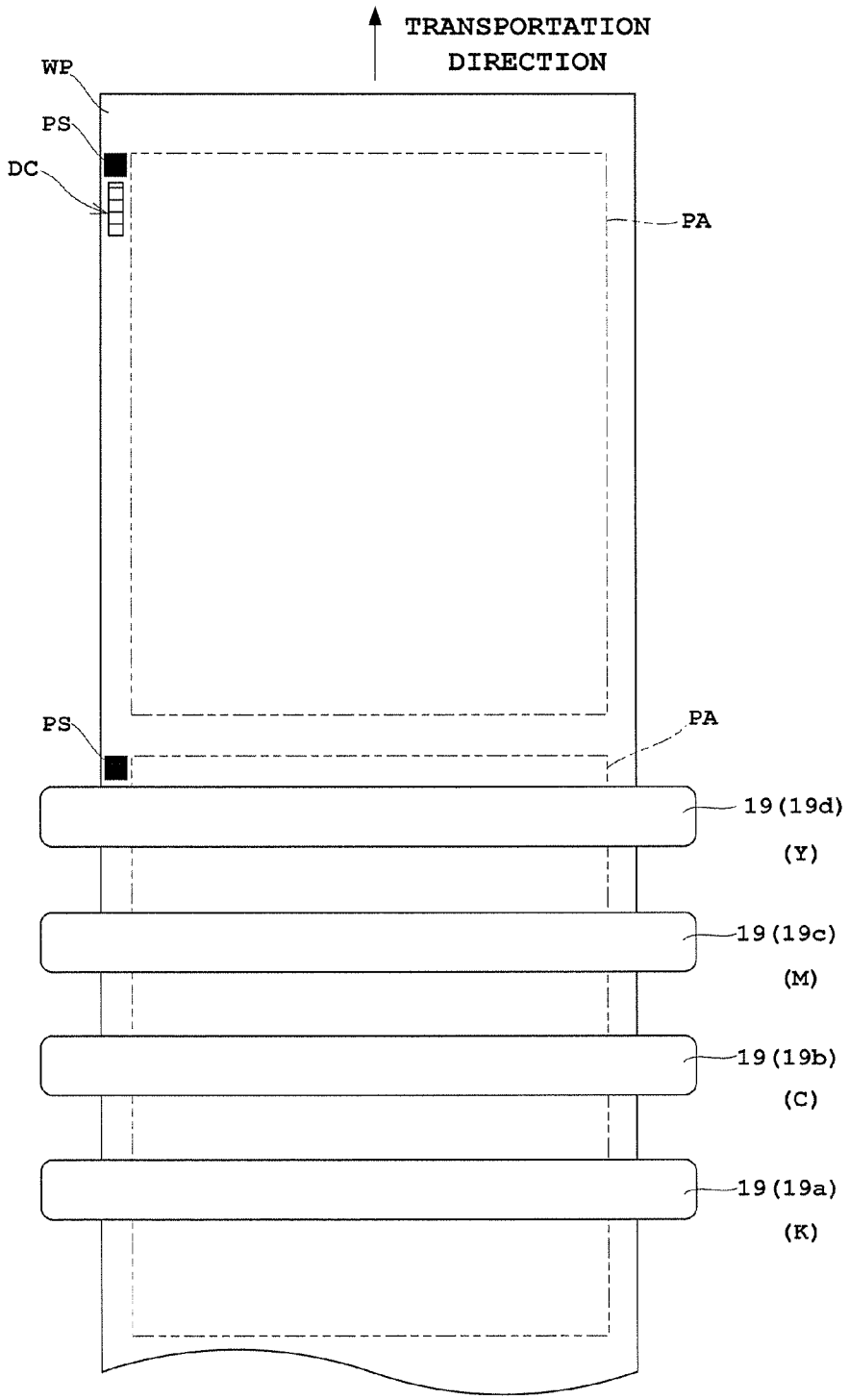
FIG. 2 is a schematic view illustrating a positional relationship in plan view between web paper and printing heads.

FIG. 1 is a schematic view illustrating an entire inkjet printing system according to one embodiment of the present invention. FIG. 2 is a schematic view illustrating a positional relationship in plan view between web paper and printing heads.

The inkjet printing system according to one embodiment of the present invention includes a paper feeder 1, an inkjet printing apparatus 3, and a take-up roller 5.

The paper feeder 1 holds the web paper WP in a roll form to be rotatable about a horizontal axis. The paper feeder 1 unwinds the web paper WP to feed the web paper WP to the inkjet printing apparatus 3. The take-up roller 5 winds up the web paper WP printed by the inkjet printing apparatus 3 about a horizontal axis. Regarding the side from which the web paper WP is fed as upstream and the side to which the web paper WP is taken up as downstream, the paper feeder 1 is disposed upstream of the inkjet printing apparatus 3 whereas the take-up roller 5 is disposed downstream of the inkjet printing apparatus 3.

The inkjet printing apparatus 3 includes a drive roller 7 upstream thereof for taking in the web paper WP from the paper feeder 1. The web paper WP unwound from the paper feeder 1 by the drive roller 7 is transported downstream toward the take-up roller 5 along transport rollers 9. A drive roller 11 is disposed between the most downstream transport roller 9 and the take-up roller 5. The drive roller 11 feeds the web paper WP transported on the transport rollers 9 toward the take-up roller 5.

Here, the inkjet printing apparatus 3 corresponds to the "printing apparatus" in the present invention. The drive rollers 7 and 11 and the transport roller 9 correspond to the "transporting device" in the present invention. The web paper WP corresponds to the "print medium" in the present invention.

The inkjet printing apparatus 3 further includes a print unit 13, a drier 15, and an inspecting unit 17 in this order from upstream thereof between the drive rollers 7 and 11. The drier 15 dries portions printed by the print unit 13. The inspecting unit 17 collects images on a print surface, and inspects the images for any stains or omissions.

The inspecting unit 17 corresponds to the "photographing unit" in the present invention.

The print unit 13 has a plurality of printing heads 19 for discharging ink droplets. In the present embodiment, four printing heads 19 are provided as one example.

The printing heads 19 are formed by a printing head 19*a*, a printing head 19*b*, a printing head 19*c*, and a printing head 19*d* in this order from upstream thereof. In this specification, when the printing heads 19 should be identified individually, an alphabetical numeral (e.g., a) is applied to the numeral 19. Otherwise, only the numeral 19 is indicated. The printing heads 19 each have a plurality of inkjet nozzles 21 for discharging ink droplets individually. The inkjet nozzles 21 are arranged in a transportation direction of the web paper WP and in an orthogonal direction relative to the transportation direction of the web paper WP. The printing heads 19*a* to 19*d* discharge ink droplets in at least two colors, and allows multi-color printing on the web paper WP. For instance, the printing head 19*a* discharges ink droplets in black (K), the printing head 19*b* discharges ink droplets in cyan (C), printing head 19*c* discharges ink droplets in magenta (M), and the printing head 19*d* discharges ink droplets in yellow (Y). The printing heads 19*a* to 19*d* are each spaced away from one another at given intervals in the transportation direction with respect to a position of the printing head 19*a* that discharges ink droplets in black (K).

A controller 25 includes a CPU and a memory not shown. The controller 25 receives print data from an external computer, not shown, and converts the print data into print-processing data. Thereafter, the controller 25 operates the drive rollers 7 and 11 to transport the web paper WP while the printing heads 19 discharge ink droplets in accordance with the print-processing data, whereby images based on the print data are printed on the web paper WP. The controller 25 stores in advance the print-processing data on the shift detecting chart for detecting the transportation speed of the web paper WP in the transportation direction. When an operator of the inkjet printing system issues a command to print the shift detecting chart, the controller 25 reads the print-processing data on the shift detecting chart, and the controller 25 operates the drive rollers 7, 11 and the printing heads 19 to print the shift detecting chart on the web paper WP.

A correcting unit 27 calculates a correction value for a shift obtained with the shift detecting chart, which is to be mentioned later. The calculated correction value is transmitted to the controller 25. The controller 25 sequentially corrects a timing of discharging the ink droplets from the printing heads 19 depending on the correction value in accordance with the print-processing data.

The correcting unit 27 corresponds to the "correcting device" in the present invention.

As illustrated in FIG. 2, a shift detecting chart DC is printed beyond a printing area PA in the web paper WP. A printing start mark PS representing a printing start position in the transportation direction is formed adjacent to an upstream of the printing area PA. The printing start mark PS is typically used for alignment of both surfaces of the web paper WP or for post-processing. The shift detecting chart DC is preferably formed as small as possible below the printing start mark PS. The shift detecting chart DC arranged immediately below the printing start mark PS achieves correction at a timing earlier than the case of the shift detecting chart DC arranged adjacent to the lower end of the printing area PA. In addition, the shift detecting chart DC formed as small as possible outside the printing area PA yields a suppressed influence on density detection when the shift detecting chart DC is formed on the rear face of the web paper WP.

Figure 3:
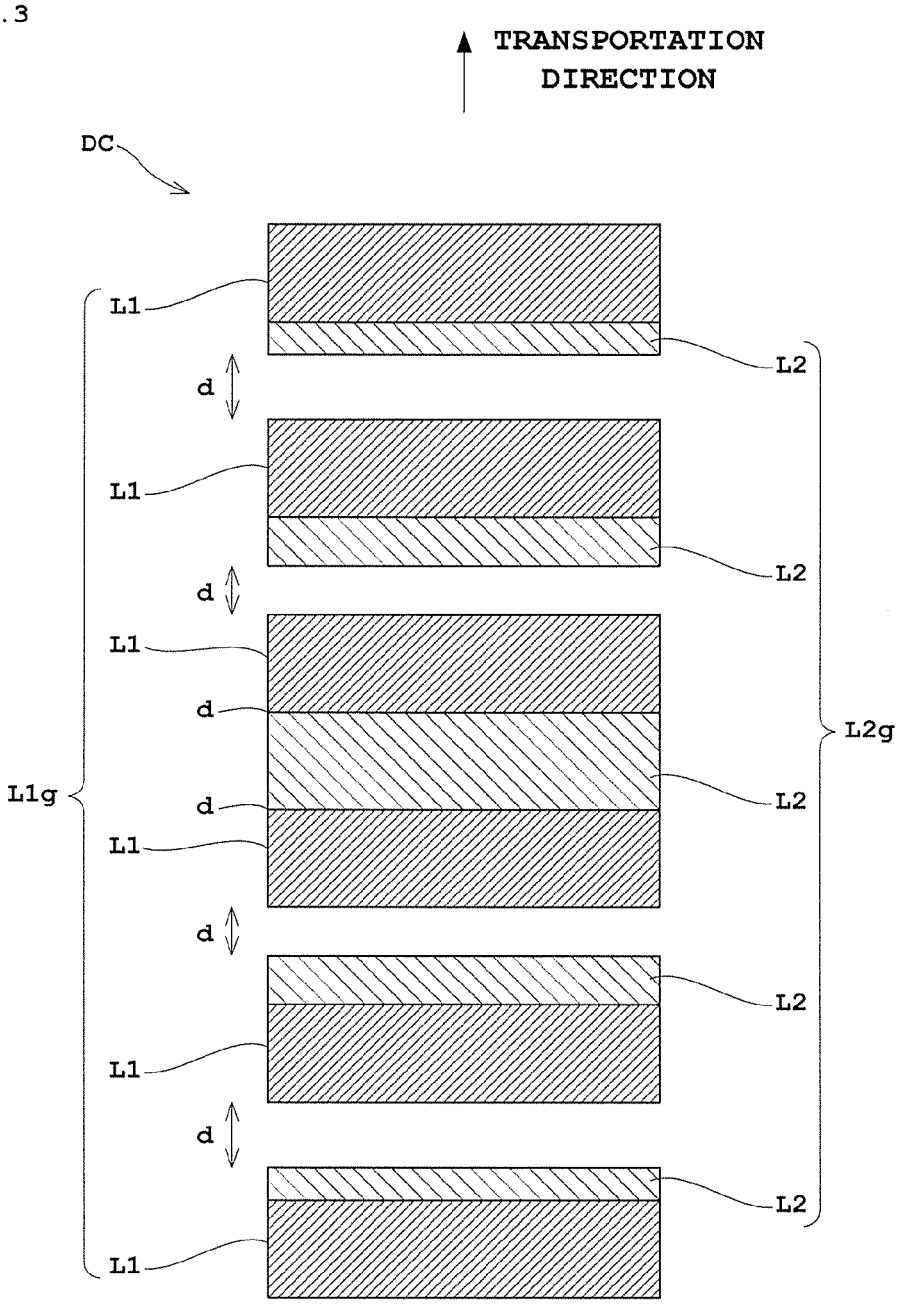
FIG. 3 is an enlarged view of a shift detecting chart.

The following describes the shift detecting chart DC with reference to FIG. 3. FIG. 3 is an enlarged view of the shift detecting chart.

The shift detecting chart DC includes a first line segment group L1*g* and a second line segment group L2*g*. The first line segment group L1*g* consists of line segments L1 printed on the web paper WP at given intervals in an orthogonal direction relative to the transportation direction by a printing head 19*a*. The printing head 19*a* performs first discharge among the four printing heads 19 to the web paper WP with ink droplets in black (K). The second line segment group L2*g* consists of second line segments L2 printed by a printing head 19*d* that is disposed most downstream of the four printing head 19 in the transportation direction away from the printing head 19*a*, and discharges ink droplets in yellow (Y). The second line segment group L2*g* is formed along the first line segment group L1*g* in such a way that distances d between the second line segments L2 and the first line segments L1 become sequentially small toward downward and then become sequentially large.

The second line segment group L2*g* in the shift detecting chart DC that consists of second line segments L2 may be formed along the first line segment group L1*g* in such a way that distances d to the first line segment L1 become large sequentially from upstream toward downstream and then distances d to the first line segment L1 become sequentially small.

Here, the printing head 19*a* corresponds to the "reference printing head" in the present invention. The printing head 19*d* corresponds to the "subsequent printing head" in the present invention. Both the printing heads 19*a* and 19*d* correspond to the "shift detecting chart forming device" in the present invention.

Figure 4:
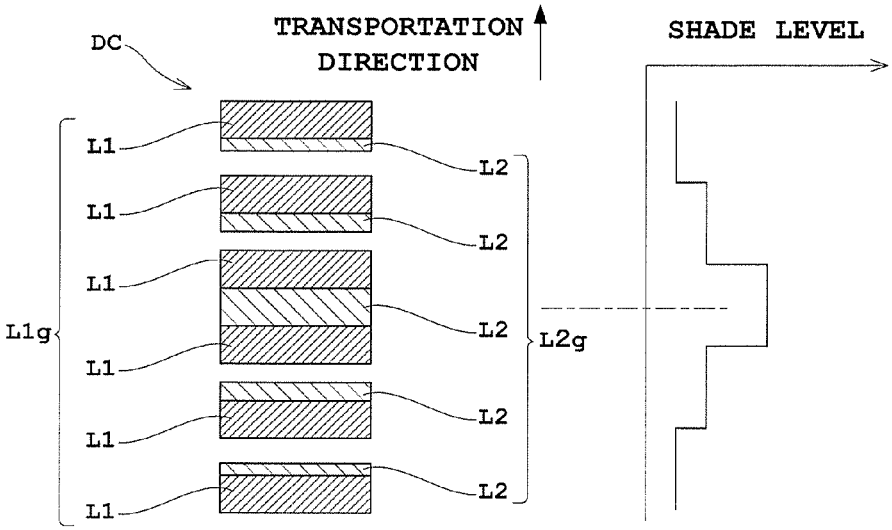
FIG. 4 is a graph illustrating a shift detecting chart and a distribution of shade levels with no variation in transportation speed.
Figure 5:
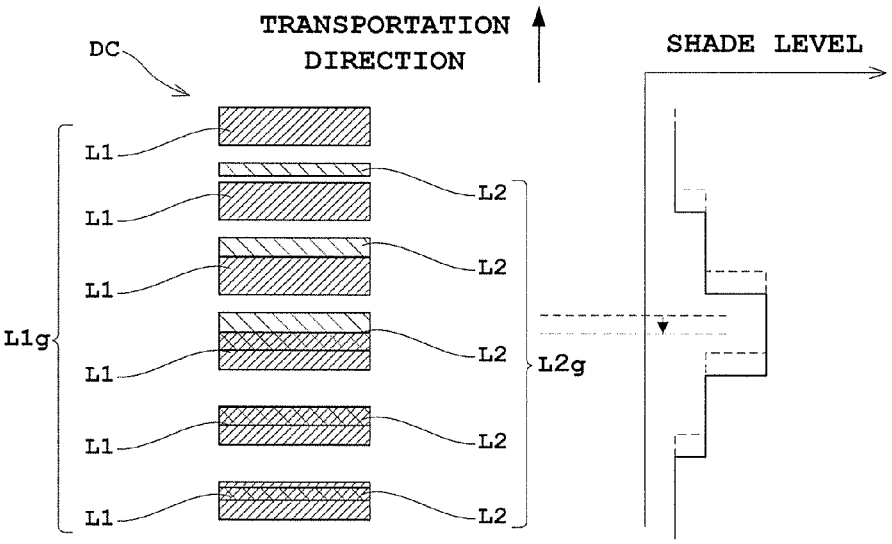
FIG. 5 is a graph illustrating a shift detecting chart and a distribution of shade levels with a variation in transportation speeds.

Reference is now made to FIGS. 4 and 5. FIG. 4 is a graph illustrating a shift detecting chart and a distribution of shade levels with no variation in transportation speed. FIG. 5 is a graph illustrating a shift detecting chart and a distribution of shade levels with a variation in transportation speed.

The inspecting unit 17 photographs the shift detecting chart DC printed on the web paper WP. The inspecting unit 17 photographs the web paper WP containing the printing area PA over a width of the web paper WP to obtain image data, and inspects the printing area PA in accordance with the image data. In addition, in the present embodiment, the correcting unit 27 fetches a density distribution of the shift detecting chart DC from the image data obtained by the inspecting unit 17 as shade levels. FIG. 4 illustrates a condition in which the first line segment group L1*g* is not shifted from the second line segment group L2*g*, i.e., no transportation speed of the web paper WP is variable between when the printing head 19*a* performs printing and when the printing head 19*d* performs printing. In such a reference condition, a shade level at the middle of the second line segments L2 by ink droplets in yellow (Y) is the highest. The correcting unit 27 stores in advance this position as a reference.

FIG. 5 illustrates one example of a condition in which the second line segment group L2*g* is shifted upstream of the first line segment group L1*g*. This means that the transportation speed of the web paper WP when the printing head 19*d* performs printing is higher than that when the printing head 19*a* performs printing. In other words, a peak of the shade levels is shifted upstream relative to that in FIG. 4 as the reference. The correcting unit 27 transmits a correction value to the controller 25 for correcting the discharge timing of the ink droplets from the printing head 19*d* in accordance with a deviation amount of the shade levels from the peak position. Since a positional relationship between the printing head 19*a* and the printing head 19*d* is known, the correcting unit 27 determines the correction value for correcting a shift caused by a variation in transportation speed in accordance with the positional relationship. Then the controller 25 receives the correction value.

The correcting unit 27 detects the variation in transportation speed as a shift in accordance with a density (shade level) variation in the shift detecting chart DC for determining the correction value used for correcting the shift. Accordingly, the image data obtained by the inspecting unit 17 may be resolution lower than the printing resolution. As a result, this achieves a simplified inspecting unit 17, leading to suppression in apparatus cost.

With the present embodiment, when the transportation speed of the web paper WP by the drive rollers 7 and 11 and the transport roller 9 changes, an overlap amount of the first line segment group L1*g* and the second line segment group L2*g* changes, and a portion having a high density is moved toward one end of the shift detecting chart DC formed by the printing heads 19*a* and 19*d*. The correcting unit 27 corrects a printing timing with the printing head 19*d* relative to the printing head 19*a* in accordance with the density variation in the shift detecting chart DC obtained by the inspecting unit 17. Consequently, information on the transportation speed of the web paper WP is obtained directly from the shift detecting chart DC, achieving an enhanced printing quality while extremely minute misregister is suppressed caused by the variation in transportation speed.

Figure 6:
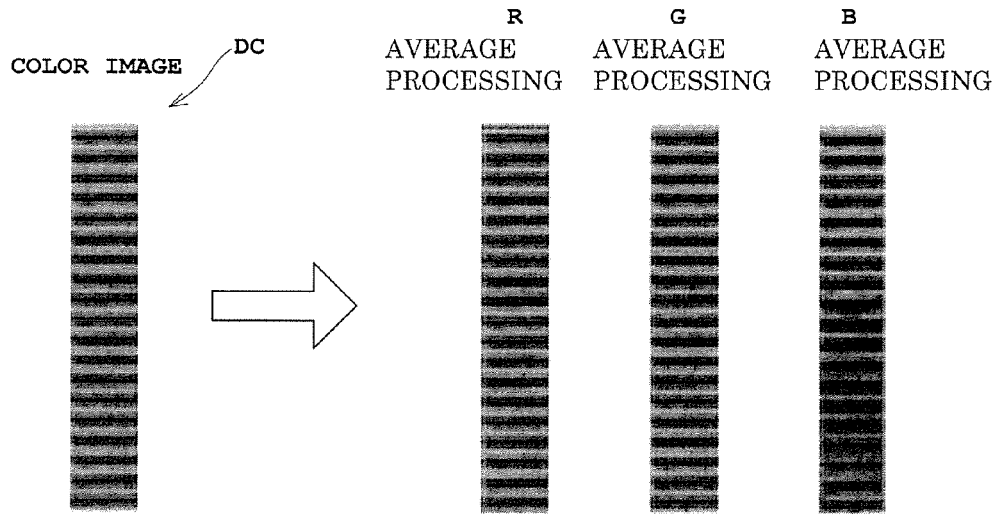
FIG. 6 illustrates a color image of the shift detecting chart and images obtained by decomposing the color image into components R, G, and B, respectively.
Figure 7:
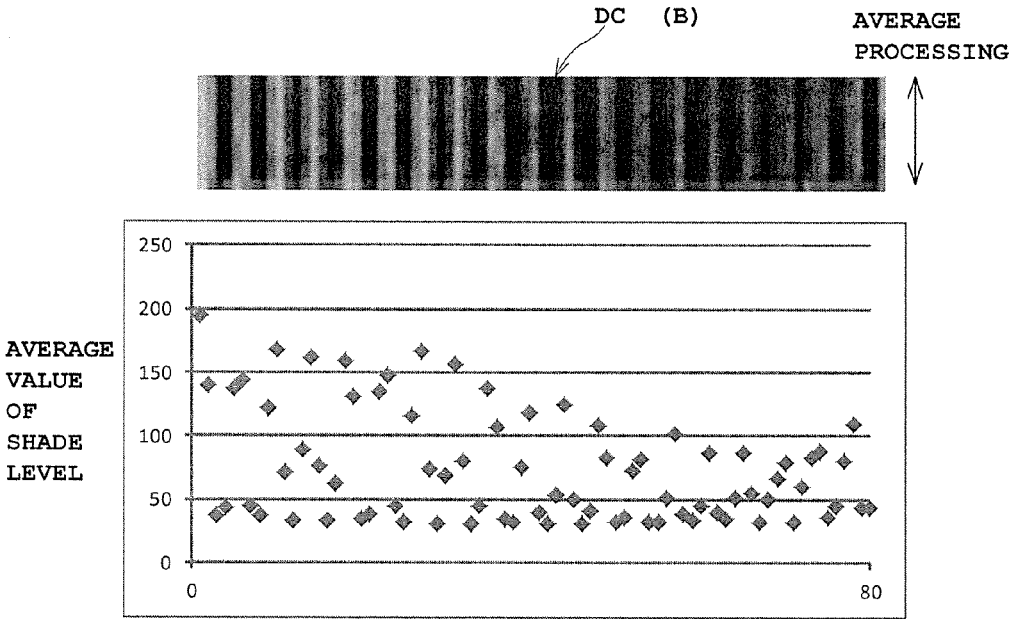
FIG. 7 is a graph illustrating an average value of the shade levels of the shift detecting chart.
Figure 8:
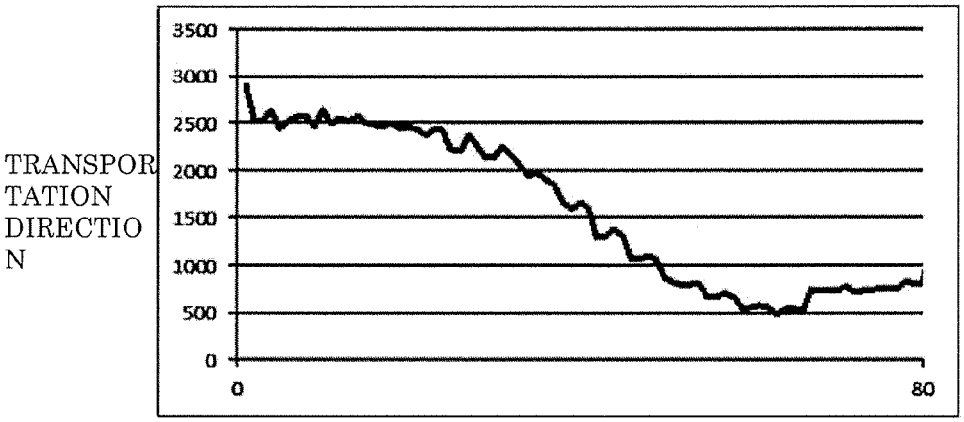
FIG. 8 is a graph illustrating variance values of the shade levels.

The following describes a preferable process of the shift detecting chart DC with reference to FIGS. 6 to 8. FIG. 6 illustrates a color image of the shift detecting chart and decomposed images into which the color image is decomposed into R, G, and B components, respectively. FIG. 7 is a graph illustrating an average value of the shade levels of the shift detecting chart. FIG. 8 is a graph illustrating a variance value of the shade levels.

The correcting unit 27 receives the image data on the shift detecting chart DC from the inspecting unit 17. The image data is a color image as illustrated on the left of FIG. 6. Consequently, the color image data is decomposed into channels of R (red), G (green), and B (blue) as illustrated in the right of FIG. 6. Then, since the density is clearly visible in the channel B (blue), the shift mentioned above is preferably distinguished with the channel.

Consequently, the density variation of the shift detecting chart DC is easily visible and thus accurate correction is performable.

In addition, as illustrated in FIG. 7, the following is preferred. That is, the correcting unit 27 determines an average value of the shade levels of the first line segment L1 and the second line segment L2 for the component B (blue) in shift detecting chart DC in a length direction upon detection of the density peak, and then determines the shift in accordance with the average value. Specifically, as illustrated in FIG. 8, it is preferred that a variance value is further determined for the shade levels. A portion with a high variance value reveals that an overlap of the black (K) and yellow (Y) is large, whereas a portion with a low variance value reveals that an overlap of the black (K) and yellow (Y) is small. The shift is determinable from a difference between the portions and the reference.

Determination of the shift in such a manner as above achieves accurate correction of the printing timing even with an uneven distribution of density in a length direction of the line segments L1 and L2 in the shift detecting chart DC.

The present invention is not limited to the foregoing examples, but may be modified as follows.

Figure 9:
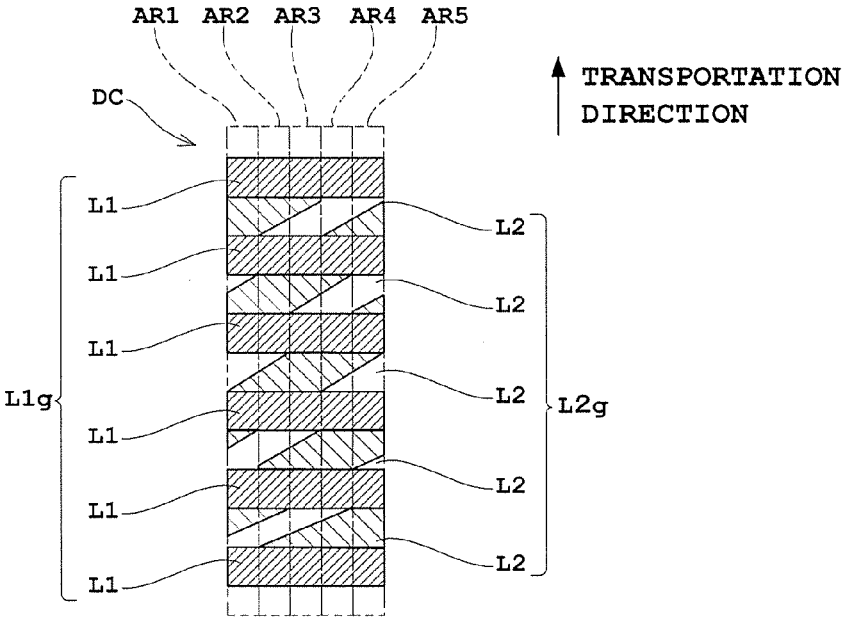
FIG. 9 illustrates a shift detecting chart according to one modification of the present invention.

(1) In the embodiment mentioned above, the shift detecting chart DC has the first line segment L1 and the second line segment L2 formed in parallel as illustrated in FIG. 3. However, the present invention is not limited to such an aspect. For instance, a shift detecting chart DC as in FIG. 9 is adoptable.

In this shift detecting chart DC, the first line segment group L1*g* is formed in the same manner as in the above embodiment. However, a second line segment group L2*g* is different from that in the above embodiment. Specifically, second line segments L2*g* each have a density inclination in a line segment direction of the first line segment group L1*g*. The density inclination divides lengths of the line segments L1 and L2 into five regions AR1 to AR5 in an orthogonal direction relative to the length direction, and generates a second line segment group L2*g* (density inclined line group) in such a way that the regions AR1 to AR5 each have a different portion with a high yellow (Y) density. Such a configuration obtains five density peaks with one shift detecting chart DC, and the shift is averaged from ever reference thereof. This allows accurate determination of the shift.

(2) In the embodiment mentioned above, the web paper WP has been described as one example of the print medium. However, the print medium is not limited to the web paper WP in the present invention. For instance, a paper sheet or a film is applicable.

(3) The embodiment mentioned above illustrates an inkjet type printing apparatus. However, a printing apparatus with printing heads spaced away in a paper-feed direction is applicable to the present invention.

(4) The embodiment mentioned above adopts the printing head 19*a* as the reference printing head. Alternatively, any of the printing heads 19*b* to 19*c* may be used as the reference printing head. Moreover, the above embodiments adopt the printing head 19*d* as the subsequent printing head. Alternatively, any of the printing heads 19*a* to 19*d* may be used as long as it is different from the reference printing head.

(5) In the embodiment mentioned above, the shift is distinguished based on the component B (blue) in the color image of the shift detecting chart DC. However, the present invention is not limited to this. If the ink droplets are formed by different colors other than KCMY, the shift may be determined based on a color component other than the component B (blue).

The present invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus for performing printing onto a print medium, the printing apparatus comprising:

a transporting device;

a plurality of printing heads;

a photographing unit;

a shift detecting chart forming device; and a correcting device, the transporting device transporting a print medium, the printing heads being spaced away from one another in a transportation direction of the print medium and printing an image onto the print medium, the photographing unit photographing the print medium onto which the printing is performed with the printing heads, the shift detecting chart forming device forming a shift detecting chart having a first line segment group and a second line segment group, the first line segment group consisting of first line segments printed onto the print medium at given intervals in an orthogonal direction with respect to the transportation direction with a reference printing head of the printing heads for a reference printing position in the transportation direction, the second line segment group being formed along the first line segment group, and consisting of second line segments printed with a subsequent printing head of the printing heads spaced away from the reference printing head in the transportation direction in such a way that distances to the first line segments become small sequentially and then distances becomes large sequentially in a direction from one of the first line segments to another one of the first line segments, or in such a way that distances to the first line segments become large sequentially and then distances becomes small sequentially in a direction from one of the first line segments to another one of the first line segments, and the correcting device correcting a printing timing with the subsequent printing head relative to the reference printing head in accordance with a density variation of the shift detecting chart photographed with the photographing unit.

2. The printing apparatus according to claim 1, wherein the shift detecting chart forming device forms the shift detecting chart following a printing start mark printed beyond a printing area of the print medium.

3. The printing apparatus according to claim 2, wherein the correcting device corrects the printing timing in accordance with one of color components into which the shift detecting chart photographed with the photographing unit is decomposed.

4. The printing apparatus according to claim 3, wherein the correcting device corrects the printing timing in accordance with an average value of shade levels of the line segments in one of the color components in a length direction.

5. The printing apparatus according to claim 4, wherein when the reference printing head performs printing in black and the subsequent printing head performs printing in yellow, the correcting device corrects the printing timing in accordance with a blue component of the color components in the shift detecting chart photographed with the photographing unit.

6. The printing apparatus according to claim 5, wherein the correcting device corrects the printing timing in accordance with an average value of shade levels in the blue component in the shift detecting chart in the length direction.

7. The printing apparatus according to claim 3, wherein when the reference printing head performs printing in black and the subsequent printing head performs printing in yellow, the correcting device corrects the printing timing in accordance with a blue component of the color components in the shift detecting chart photographed with the photographing unit.

8. The printing apparatus according to claim 7, wherein the correcting device corrects the printing timing in accordance with an average value of shade levels in the blue component in the shift detecting chart in the length direction.

9. The printing apparatus according to claim 2, wherein The printing heads each includes a plurality of inkjet nozzles that discharges ink droplets individually.

10. The printing apparatus according to claim 1, wherein the correcting device corrects the printing timing in accordance with one of color components into which the shift detecting chart photographed with the photographing unit is decomposed.

11. The printing apparatus according, to claim 10, wherein the correcting device corrects the printing timing in accordance with an average value of shade levels of the line segments in one of the color components in a length direction.

12. The printing apparatus according to claim 11, wherein when the reference printing head performs printing in black and the subsequent printing head performs printing in yellow, the correcting device corrects the printing timing in accordance with a blue component of the color components in the shift detecting chart photographed with the photographing unit.

13. The printing apparatus according to claim 12, wherein the correcting device corrects the printing timing in accordance with an average value of shade levels in the blue component in the shift detecting chart in the length direction.

14. The printing apparatus according to claim 11, wherein The printing heads each includes a plurality of inkjet nozzles that discharges ink droplets individually.

15. The printing apparatus according to claim 10, wherein when the reference printing head performs printing in black and the subsequent printing head performs printing in yellow, the correcting device corrects the printing timing in accordance with a blue component of the color components in the shift detecting chart photographed with the photographing unit.

16. The printing apparatus according to claim 15, wherein the correcting device corrects the printing timing in accordance with an average value of shade levels in the blue component in the shift detecting chart in the length direction.

17. The printing apparatus according to claim 16, wherein The printing heads each includes a plural of inkjet nozzles that discharges ink droplets individually.

18. The printing apparatus according to claim 10, wherein The printing heads each includes a plurality of inkjet nozzles that discharges ink droplets individually.

19. The printing apparatus according to claim 15, wherein The printing heads each includes a plurality of inkjet nozzles that discharges ink droplets individually.

20. The printing apparatus according to claim 1, wherein The printing heads each includes a plurality of inkjet nozzles that discharges ink droplets individually.

* * * * *